United States Patent [19]

Wiewiorowski et al.

[11] Patent Number: 4,510,027

[45] Date of Patent: Apr. 9, 1985

[54] SIMULTANEOUS LEACHING AND ELECTRODEPOSITION OF PRECIOUS METALS

[75] Inventors: Tadeusz Wiewiorowski; Phillip D. Mollere, both of New Orleans, La.

[73] Assignee: Freeport Minerals Company, New York, N.Y.

[21] Appl. No.: 567,155

[22] Filed: Jan. 4, 1984

Related U.S. Application Data

[63] Continuation of Ser. No. 254,548, Apr. 15, 1981, abandoned.

[51] Int. Cl.[3] ..... C25C 1/20

[52] U.S. Cl. ..... 204/110; 204/109; 204/111

[58] Field of Search ..... 204/109, 110, 111; 75/105

[56] References Cited

U.S. PATENT DOCUMENTS

| | | | |
|---|---|---|---|
| Re. 14,849 | 4/1920 | Holden . | |
| 61,866 | 2/1967 | Rae | 204/109 |
| 62,776 | 3/1967 | Rae | 204/109 |
| 272,391 | 2/1883 | Thiollier . | |
| 538,522 | 4/1895 | Kendall . | |
| 543,673 | 7/1985 | Crawford . | |
| 588,740 | 8/1897 | Becker . | |
| 601,068 | 3/1898 | Von Siemens . | |
| 641,571 | 1/1900 | Witter . | |
| 643,096 | 2/1900 | Christy . | |
| 654,437 | 7/1900 | Caldecott . | |
| 668,842 | 2/1901 | Rouse | 204/273 |
| 698,292 | 4/1902 | Kendall . | |
| 714,599 | 11/1902 | Muffly . | |
| 719,207 | 1/1903 | Gage . | |
| 775,597 | 11/1904 | Cassel . | |
| 785,214 | 3/1905 | Hendryx . | |
| 836,380 | 11/1906 | Hendryx | 204/109 |
| 873,943 | 12/1907 | Johnson . | |
| 889,128 | 5/1908 | Hendryx . | |
| 893,472 | 7/1908 | Forget | 204/273 |
| 962,040 | 6/1910 | McPherson . | |
| 976,045 | 11/1910 | Clancy . | |
| 978,211 | 12/1910 | Robertson | 204/110 |

(List continued on next page.)

FOREIGN PATENT DOCUMENTS

| | | |
|---|---|---|
| 14966 | of 1890 | United Kingdom . |
| 21221 | of 1890 | United Kingdom . |
| 3086 | of 1896 | United Kingdom . |
| 497835 | 5/1937 | United Kingdom . |

OTHER PUBLICATIONS

The New Encyclopedia Britannica, Macropaedia, vol. 8, (1974), p. 238.

Clancy, John Collins, The Clancy Electrochemical Cyanide Process (circa 1910).

*Primary Examiner*—R. L. Andrews

*Attorney, Agent, or Firm*—Fisher, Christen & Sabol

[57] ABSTRACT

A method for the recovery of precious metals such as gold and silver from various ore types is described which involves subjecting a slurry of the ore to a simultaneous leaching and electrodeposition process by mixing the slurry with a reagent such as an alkaline cyanide solution which provides for the leaching requirement and contacting said slurry with a metallic cathode with a negative electric potential applied thereto providing for the electrodeposition requirement. The cathode is made of a metal selected from the group consisting of cadmium, copper, iron, lead, molybdenum, tin, zinc, cobalt, nickel, silver, titanium, tungsten, vanadium and alloys and mixtures containing at least one of these metals. The simultaneous leaching and electrodeposition occur under conditions controlled to afford at least partial dissolution of the precious metal values from the ore, whereby continuous transfer of the precious metal from the ore onto the surface of the cathode is promoted. The resultant electrodeposition product, i.e., the cathode with precious metal values electrodeposited thereon, is then separated from the ore slurry and subjected to a subsequent precious metal recovery step by conventional methods.

28 Claims, 1 Drawing Figure

U.S. PATENT DOCUMENTS

| | | | |
|---|---|---|---|
| 989,804 | 4/1911 | Rennie . | |
| 998,749 | 7/1911 | Clancy . | |
| 1,082,596 | 12/1913 | Kitsee . | |
| 1,120,191 | 12/1914 | Gibbs . | |
| 1,231,967 | 7/1917 | Tainton et al. . | |
| 1,251,302 | 12/1917 | Tainton . | |
| 1,269,565 | 6/1918 | Holden . | |
| 1,283,236 | 10/1918 | Lockwood . | |
| 1,344,681 | 6/1920 | Dalziel . | |
| 1,739,772 | 12/1929 | Tainton . | |
| 2,735,810 | 2/1956 | Gagliano | 204/110 |
| 2,843,538 | 7/1958 | Haugen | 204/130 |
| 3,063,921 | 11/1962 | Leibowitz | 204/110 |
| 3,826,723 | 7/1974 | Woods | 204/110 |
| 3,836,443 | 9/1974 | MacGregor | 204/105 |
| 4,128,462 | 12/1978 | Ghiringhelli et al. | 204/109 |
| 4,139,432 | 2/1979 | Ghiringhelli et al. | 204/110 |

SIMULTANEOUS LEACHING AND ELECTRODEPOSITION OF PRECIOUS METALS

This application is a continuation, of application Ser. No. 254,548, filed Apr. 15, 1981 now abandoned.

BACKGROUND OF THE INVENTION

1. Field of The Invention

This invention relates to a process for the recovery of precious metals from carbonaceous ores and mixtures of carbonaceous and oxide ores containing such metals by leaching and electrodeposition techniques.

2. Prior Art

Present practices in the field of gold and silver recovery from ores often require segregation of such ores prior to their processing, of which ores there are two basic types: first, oxide ores from which precious metal values are easily extracted by present cyanidation techniques, and second, carbonaceous ores which are refractory to conventional cyanidation techniques and which are characterized by their organic carbon content, which is normally between 0.25 and 3% by weight. To render the latter more amenable to cyanide extraction a single- or multi-stage pretreatment prior to cyanidation is normally required to prevent the carbonaceous component of the ore from adsorbing the gold- or silver-cyanide complex formed during leaching. This pretreatment alone can consume up to approximately thirty hours of processing time and necessitates costly plant equipment and operating expenditures. When more than one type of ore have to be treated the types must be segregated prior to treatment and treated by different techniques. These techniques are usually time consuming and necessitate costly plant equipment and operating expenditures.

Various patents have separately addressed the use of electrodeposition to recover precious metals from oxide and similar type of ores. Thus, for example, U.S. Pat. No. 836,380 (Hendryx) teaches the recovery of gold and silver from oxide-type gold-ferrous ores and oxide-type silver-ferrous ores by forming a pulp of cyanide and ore which is crushed, amalgamated and ground. Suitable chemicals are then added to eliminate certain deleterious acid salts and the pulp is allowed to settle, after which the cyanide level is built back up and the pulp is subjected to an electrical current of seven to ten volts to electrodeposit the metal values. The patent does not disclose the addition of a base to maintain an alkaline pH or the simultaneous leaching and electrodeposition process of this invention.

U.S. Pat. No. 668,842 (Rouse) discloses an apparatus for the extraction of gold and silver from their ores by electrolytically treating the ore pulp. The pulp is placed in a vessel, the desired reagents are added and an electrical potential of 5 to 10 volts is then applied. The cathodes are made of gold and silver from previously used cathodes, and the gold and silver precipitate thereon. Rouse's patent does not address the processing of carbonaceous ores or mixtures of carbonaceous and oxide ores, nor does it disclose the conditions for providing the partial dissolution of the precious metal values needed to conduct the simultaneous leaching and electrodeposition of this invention.

U.S. Pat. No. 893,472 (Forget) discloses another apparatus for recovering gold from slimes and gold-bearing ores in a weak cyanide solution with an electric current, but fails to disclose the conditions necessary to provide for the partial dissolution of the precious metal values needed to conduct the simultaneous leaching and electrodeposition of this invention.

U.S. Pat. No. 978,211 (Robertson) discloses injecting powdered ore into an electrolyte in a tank. When the ore contains gold, the electrolyte can be potassium cyanide. The electrolyte is agitated by steam or hot air while subjected to an electrical current. The process of simultaneous leaching and electrodeposition, as described in the present invention, does not appear in said patent.

U.S. Pat. Nos. 61,866 (Rae I) and 62,776 (Rae II) teach treating pulverized gold- or silver-bearing ore in potassium cyanide solution with agitation and electrical current but fail to disclose the conditions for providing the partial dissolution of the precious metal values needed to conduct the simultaneous leaching and electrodeposition of this invention.

BROAD DESCRIPTION OF THE INVENTION

In view of the above prior art and the conventional methods of processing ores containing precious metal values, it is an object of this invention to provide an improved process for the recovery of precious metals from their ores.

A general object of this invention is to provide a process for the simultaneous leaching and electrodeposition of precious metals such as gold and silver. A particular object of this invention is to provide a simultaneous leaching and electrodeposition process which allows the use of small ratios of cathode metal surface to ore weight and small electric potentials. A further object of this invention is to provide an improved method for the recovery of precious metals from refractory, carbonaceous ores. A still further object of this invention is to provide a process for the recovery of precious metals from their ores which does not require a pretreatment stage for aggressive oxidation, such as roasting, chlorination or the like. Another object of this invention is to provide a process for the recovery of precious metals from mixed carbonaceous-oxide ores which does not require the segregation of such two ore types. An important object of this invention is to provide a process for the recovery of precious metals from their ores which does not suffer from the disadvantages of prior art processes and which, at the same time, provides improved recoveries. Other objects and advantages of this invention will be set out herein or will be obvious herefrom to one ordinarily skilled in the art.

The objects and advantages set forth above are achieved by the process of this invention.

This invention provides a process for the recovery of precious metals such as gold and silver from various types of ores including carbonaceous or refractory ores, and from mixtures of carbonaceous and oxide ores. The process of this invention includes subjecting an aqueous slurry of ground ore to simultaneous leaching and electrodeposition at an elevated temperature by adding a precious metal-complexing agent to the slurry and contacting said slurry with a metallic cathode to which a negative (external) electric potential is applied. The cathode is made of a metal selected from the group consisting of cadmium, copper, iron, lead, molybdenum, tin, zinc, cobalt, nickel, silver, titanium, tungsten, vanadium and alloys and mixtures containing at least one of these metals. A suitable anode is provided and such anode is constructed from materials which are good electrical conductors and which are resistant to anodic oxidation and corrosion. The metallic cathode and the precious metal-complexing agent may be added simultaneously or consecutively to the slurry. An alkaline additive is also added to the slurry to maintain its liquid phase at a pH higher than 9. This process thereby achieves simultaneous leaching and electrodeposition by facilitating the simultaneous transfer of the precious metal from the ore to the liquid phase (leaching) and from the liquid phase to the negatively charged metal (electrodeposition).

The slurry-cathode contact is brought about under controlled conditions, which in turn facilitate the process of simultaneous leaching and electrodeposition, wherein the precious metal values undergo continual transfer from the ore to the surface of the metallic cathode. It is a uniquely advantageous feature of this invention that the process conditions only require the precious metal concentrations of the liquid phase of the slurry to remain, at any point in time during the processing of the ore, at a level substantially lower than that representing the total precious metal contained in the ore. In fact, the precious metal concentration of the liquid phase remains throughout the leaching and electrodeposition process at a level equivalent to between 0.01 percent and 70 percent of the total precious metal contained in the ore. Once electrodeposition has occurred, conventional methods can be employed to recover the metal values.

PREFERRED EMBODIMENT OF THE INVENTION

This invention provides an improved process for the recovery of precious metals from various types of ores, including carbonaceous or refractory ores and mixtures of carbonaceous ores and oxide ores. The fraction of oxide ore in the mixtures of carbonaceous and oxide ores contemplated by the process of this invention may vary. Such mixtures usually contain up to 70 percent of oxide ore. What is characteristic of the types of ore mixtures contemplated is that they are not amenable to standard cyanidation techniques, i.e., less than about 50 percent precious metal extraction is obtainable from them when treated by conventional straight cyanidation methods. The process is not limited to the recovery of gold, but is also applicable to the recovery of silver. For simplicity, however, gold recovery will serve henceforth to illustrate the application of the process.

In accordance with the process, an aqueous slurry of ground, gold-containing ore is treated with an alkaline cyanide solution and contacted with a metallic cathode and a suitable anode. The cathode is made of a metal selected from the group consisting of cadmium, copper, iron, lead, molybdenum, tin, cobalt, nickel, silver, titanium, tungsten, vanadium, zinc and alloys and mixtures containing at least one of these metals. The selected metals provide an ability to recover 75 percent or better of the gold from the ore. Steel and stainless steel are the preferred alloys. Aluminum is not included as a useful metallic cathode due to the consistently excessive metal losses experienced with it. The anode is selected from materials which are electrical conductors and which are resistant to anodic oxidation and corrosion, such as stainless steel.

The slurry-cathode contact occurs under conditions favoring at least partial instantaneous dissolution of the gold from the ore into the aqueous phase of the slurry, thereby providing for simultaneous leaching and electrodeposition. To promote these conditions an aqueous slurry of the ground ore is prepared containing between 25 and 60 percent solids, and preferably between 35 and 50 percent solids, with ore which has been ground to a particle size of less than 10 mesh and preferably less than 48 mesh. The pH of the aqueous phase of the slurry is adjusted by the addition of an alkaline material, including alkali metal hydroxides and carbonates and alkaline earth metal hydroxides and carbonates, in an amount sufficient to provide a pH above 9, with a pH value between 9.5 and 12 being preferred. The preferred alkaline material is sodium carbonate. When sodium carbonate is used the desired pH is achieved by using between 5 and 100 pounds of alkaline material, expressed as $Na_2CO_3$, per ton of ore, and preferably between 10 and 75 pounds.

As used herein, alkali metal includes sodium and potassium, and alkaline earth metal includes magnesium and calcium. The alkaline material used to adjust the pH of the liquid phase can be, for example, an alkali metal carbonate, an alkali metal hydroxide, an alkaline earth metal carbonate or an alkaline earth metal hydroxide. Examples of these are sodium carbonate (preferred), potassium hydroxide, potassium carbonate, sodium hydroxide, calcium hydroxide and mixtures thereof. Other useful reagents are the oxides of an alkali metal or an alkaline earth metal, such as sodium oxide, potassium oxide, magnesium oxide, calcium oxide and mixtures thereof.

Promoting partial dissolution of the gold values and thereby providing for simultaneous leaching and electrodeposition is accomplished when using the unique combination of complexing agent, metallic cathode, alkalinity, temperature and other factors as described herein. The preferred complexing agent is sodium cyanide, which should be added to the slurry in an amount equivalent to between 0.05 to 5 grams per liter of the aqueous phase, and preferably between 0.1 and 2 grams per liter of the aqueous phase. The complexing agent can be added as a solid or, preferably, as an aqueous solution. For example, a sodium cyanide solution having between 10 and 15 percent of NaCN by weight may be used. The process is not limited to the use of sodium cyanide as the complexing agent, and other complexing agents, such as potassium cyanide, sodium chloride, sodium thiosulfate, thiourea and the like, may be utilized in this capacity.

Accordingly, an aqueous slurry of ground, gold-containing ore is simultaneously treated with a complexing agent and contacted with a metal cathode, as defined hereinabove, on which a negative electric potential of preferably from about $-1.0$ to $-3.0$ volts is impressed. The negative electric potential should be between $-0.3$ volts and $-5.0$ volts, and the selection of the magnitude of the applied voltage may be influenced by the cathode metal selected and can be properly adjusted by those skilled in the art. As used herein, negative electric potential refers to the electric potential on the cathode as measured with reference to the electric potential of the corresponding anode. The application of the negative potential on the metallic cathode helps protect against cathode metal losses incurred in the leaching environment. Application of a negative electric potential on the cathode metal also affords a cathodic surface for the electrodeposition of precious metal values.

Since the form of the metal must be such that an electric potential can be applied, powder forms are not contemplated. However, almost any physical arrangements with forms of metal which afford the application of an electric potential, such as plates, screens, turnings, etc., are contemplated. Accordingly, a change in the metal form can require specific arrangement conditions for the slurry-cathode contact and, therefore, various physical arrangements can be employed to achieve the desired leaching and electrodeposition process. The slurry, for example, may be pumped through a column packed with metal turnings, or, alternatively, metal sheets may be suspended directly in the slurry contained in a tank provided with means affording agitation. To effectively carry out the process the cathode metal used should provide for a ratio of metal surface to ore of from 0.01 to 1.0 square foot per pound of dry ore being treated, depending on the type of ore, the cathode metal chosen, its physical form, and the gold concentration of the ore being treated. Preferably, from 0.02 to 0.8 square foot per pound of dry ore should be used.

In carrying out the process of simultaneous leaching and electrodeposition agitation should be provided by mechanical means and/or aeration of the slurry. The retention time required for the slurry-cathode contact—which varies with the type of ore, the cathode chosen and the conditions under which the ore is treated—is in excess of about thirty minutes and preferably ranges between 1 and 48 hours. The required temperature is above 100° F., and preferably between 140° and 200° F. Temperatures higher than 200° F. may be employed so long as adverse effects, such as excessive evaporation, do not result. The process pressure may exceed atmospheric pressure; however, the preferred process pressure is atmospheric.

In order to enhance the performance of the process an assortment of additives, such as salts of lead, copper and other metals, may be optionally introduced into the aqueous phase of the ore slurry to promote and accelerate the electrodeposition of gold onto the metal surface. Also, oxygen or compressed air may be optionally sparged through the slurry prior to and/or during the slurry-cathode contact to enhance the effectiveness of the leaching and electrodeposition step.

In one embodiment a slurry of the gold-containing ore is prepared, followed first by addition of a pH adjustor and, second, by addition of a gold-complexing agent, after which the ore slurry is contacted with a metal, with a negative electric potential applied thereto, under conditions favoring at least partial solubilization of gold to effect simultaneous leaching and electrodeposition. It should be pointed out, however, that the process is not limited to this order of reagent addition. Thus, blending the ore with an aqueous solution to which the alkaline material and the gold-complexing agent have already been added, is also permissible. Since the cathode metal may have a number of suitable forms, such as turnings, plates, and rods, the point at which the contact of the ore slurry with the cathode is initiated may vary. For example, if the physical arrangement for the slurry-cathode contact employed towers packed with a suitable form of the metal, such as balls or turnings, then a fully prepared slurry, that is, one already preheated, with pH adjustments made and gold-complexing agent added, may flow into and through the towers. If, for instance, the physical arrangement called for a container, such as a tank, for the slurry-cathode contact to take place, the order in which the reagents, including the metal, are added is not critical. Different physical arrangements may require variations in the practice of the process, all of which serve to demonstrate the scope of the invention without limiting it.

After obtaining the electrodeposition product, that is, the metallic cathode with the gold values deposited thereon, a cathode-slurry separation step is carried out. This step involves the separation of the gold-containing cathode from the slurry and will vary according to the physical arrangement chosen to carry out the process. For example, if the metallic cathode employed is in the form of plates suspended or immersed in a vessel containing the slurry, these plates may be withdrawn from the slurry. If the metal employed is in the form of turnings in a packed column, the column may simply be drained of the slurry. Whatever the form of the metallic cathode, once it is isolated from the slurry mechanically or manually, it can be washed of any residual slurry by dipping or rinsing with water. The gold-coated cathode is then subjected to a precious metal recovery step by conventional methods such as gold dissolution and electrolysis.

The process of this invention does not require the isolation of a gold-bearing leach liquor since electrodeposition is effected by direct contact of the slurry with the metallic cathode. Therefore, the simultaneous leaching and electrodeposition process does not use such steps as filtering, washing, and deaeration of the slurry to obtain a metal-bearing solution for the purpose of electrodeposition, and does not require complete dissolution of the precious metal values at any one point in time; instead, the process requires only partial dissolution of the precious metal values as stated hereinabove.

By way of summary, the process of this invention recovers gold and/or silver by making an aqueous slurry of ground ore, adding a pH regulator such as sodium carbonate to the slurry to adjust the pH to an alkaline level higher than 9, adding a precious metal-complexing agent, such as sodium cyanide, and contacting the slurry with a certain metallic cathode having a negative external potential applied thereto and being capable of collecting the precious metal values onto its surface.

Simultaneous leaching and electrodeposition means that both occur at the same time. By combining the two operations and providing certain prescribed conditions (the method, for example, does not work at ambient temperatures), this invention is able to achieve improved recoveries with fewer unit operations than those used in conventional precious metal recovery processes and, in particular, without any oxidative pretreatment of the slurry.

Not all metals can be used as cathode for the simultaneous leaching and electrodeposition process, but only those included in the group defined hereinabove make the unitized operation possible. A mixture of these metals may be used under certain circumstances with satisfactory results. Thus, for example, if the slurry-cathode contact is carried out in a tower, a mixture of copper and iron balls may be used to pack the tower. Also, the addition of a precious metal-complexing agent to the slurry of the ores covered by the process of this invention does not afford extensive leaching of the precious metal values in the absence of these selected cathodes. The simultaneous leaching and electrodeposition process may be effected with or without aeration of the slurry.

DETAILED DESCRIPTION OF THE DRAWING

Figure 1:
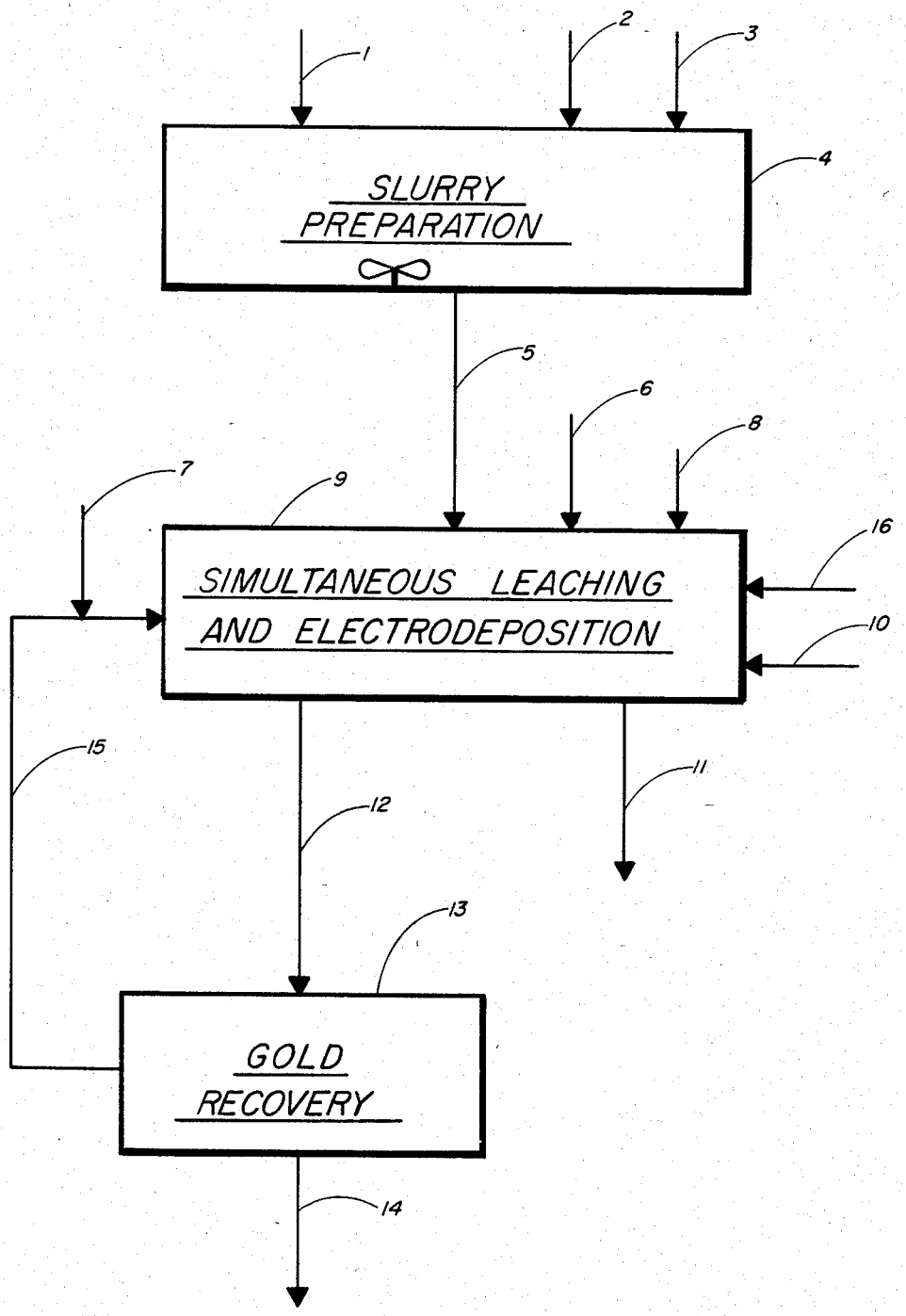

The FIGURE in the drawing is a schematic representation showing a series of processing steps of one embodiment of the invention as applied to gold recovery.

In the FIGURE, ground ore 1, water 2 and pH regulator 3 are mixed 4 to prepare aqueous slurry 5. Gold-complexing agent 6, barren cathode material 7 and air 8 are added to the aqueous slurry. To achieve simultaneous leaching and electrodeposition 9 a negative electric potential 10 is applied on the metallic cathode and heat 16 is provided to bring the temperature up to between about 140° and 200° F. The treated slurry is separated from the cathode and leaves the system as slurry tailings 11. The loaded cathode 12 is subjected to gold recovery 13 to recover gold product 14, with separated metallic cathode 15 being recycled to simultaneous leaching and electrodeposition step 9.

The following examples illustrate permissible variations of this invention, the wide range of its application and the improvements in recovery it affords. Although the examples demonstrate the simultaneous leaching and electrodeposition process in a batchwise fashion, it will be understood that the process may also be carried out as a continuous operation. As used herein, all parts, ratios, proportions and percentages are on a weight basis unless otherwise stated or otherwise obvious herefrom to one ordinarily skilled in the art.

The ore tested in Examples 1 through 9 with a gold-contaning carbonaceous ore from the area of Generator Hill in Elko County, Nevada, which contains 0.312 ounce of gold per ton of ore, 0.58 percent of organic carbon, 5.3 percent total of carbon and 0.80 percent sulfur.

Example 1 demonstrates the success afforded when practicing this invention using cobalt as the metallic cathode. In Example 2 a cobalt cathode is used, but an electrical potential is not applied to it and therefore the process fails to achieve the results obtained in Example 1. Examples 3 and 4 demonstrate successful simultaneous leaching and electrodeposition using copper and copper-coated stainless steel as the metallic cathodes, respectively, while Example 5, which also employs copper, shows the failure to achieve good results when the elevated temperatures of the invention are not used. The success achieved when practicing this invention with stainless steel as the metallic cathode is shown in Example 6, while Examples 7 and 8 demonstrate the failure to achieve good results when carrying out the process at room temperature, and without an applied potential, respectively. Finally, Example 9 demonstrates successful simultaneous leaching and electrodeposition in the absence of aeration.

EXAMPLE 1

An 880 gram sample of Generator Hill ore was prepared by crushing and grinding to a particle size of minus 100 mesh. The ore sample was slurried with water to approximately 45 percent solids and the slurry was heated to 180° F. and maintained at that temperature throughout duration of test. Adjustments in the pH of the liquor to about 11 were made by the addition of sodium carbonate in such quantities that provided for approximately 75 pounds of $Na_2CO_3$ per ton of ore. Cupric chloride was added in an amount equivalent to 50 milligrams of $CuCl_2$ per liter of aqueous phase. Aeration with 200 cc/min of air was commenced. A cathode rod formed of cobalt was suspended in the slurry and provided a ratio of metal surface to ore of 0.01 square foot per pound of ore. A negative electric potential of −2 volts was applied to the cathode and a stainless steel rod served as the anode. Sodium cyanide in an amount equivalent to 1 gram per liter of aqueous phase was admixed into the slurry. The slurry was stirred and aerated in the presence of the immersed metal for 12 hours. The phases were then separated and analyzed for gold content. The aqueous phase of the slurry was found to contain 0.04 milligram of gold per liter, and the solid phase analysis was 0.032 ounce of gold per ton—such values equate to a gold recovery of 90 percent. (Recovery is calculated from data collected of gold concentrations present in the liquid and solid phases at the time the recovery is reported.) The gold concentrations of both phases of the slurry were measured periodically throughout the duration of the test. The maximum gold concentration in the liquor was 0.90 milligram of gold per liter, which represents 10 percent of the total gold present in the ore, and it occurred 0.5 hour after initiating simultaneous leaching and electrodeposition.

EXAMPLE 2

An 880 gram sample of Generator Hill ore was tested under the same conditions and procedures as in Example 1, with the major exception that an external electric potential was not applied to the cobalt metal. After a retention time of 12 hours, the phases were separated and analyzed for gold content. The aqueous phase was found to contain less than 0.01 milligram of gold per liter; the solids analysis was 0.259 ounce of gold per ton; and a 17 percent recovery was obtained. The maximum gold concentration present in the liquor was 1.64 milligrams of gold per liter, which represents 19 percent of the total gold in the ore. The maximum gold concentration occurred 0.5 hour into the test.

EXAMPLE 3

A 270 gram sample of Generator Hill ore was prepared by crushing and grinding the ore to a particle size of minus 100 mesh and slurrying the ground ore with water to approximately 35 percent solids. The slurry was heated to 180° F. with the subsequent addition of sodium carbonate in an amount equivalent to 75 pounds of $Na_2CO_3$ per ton of ore. Copper in sheet form was introduced directly into the slurry and provided a ratio of metal surface to ore of 0.84 square foot per pound. A negative electric potential of −1.5 volts was applied on the copper and a stainless steel rod served as the anode. Sodium cyanide was then added in an amount equivalent to 1 gram per liter of liquor. The slurry was stirred and aerated with 200 cc/min of air for six hours. The phases were separated and analyzed for gold content. The liquid phase was found to contain 0.008 milligram of gold per liter; the solids analysis was 0.02 ounce of gold per ton; and a gold recovery of 93 percent was obtained. The maximum gold concentration of the liquid phase occurred approximately two hours after initiating simultaneous leaching and electrodeposition. At that time the maximum gold concentration in the liquid phase was 0.149 milligram of gold per liter, which represents 3 percent of the total amount of gold in the ore.

EXAMPLE 4

The process of this invention was tested on a 1,362 gram sample of Generator Hill ore in the same manner as in Example 1. The metallic cathode employed was copper-plated stainless steel in sheet form, which provided a ratio of metal surface to ore of 0.02 square foot per pound ore. The slurry was heated, stirred and aerated in the presence of the immersed cathode for 16 hours followed by phase separation and analysis. The aqueous phase was found to contain 0.02 milligram of gold per liter; the solid phase analysis was 0.033 ounce of gold per ton; and a recovery of 89 percent was obtained. The maximum gold concentration in the liquid was 1.83 milligram of gold per liter, which represents 21 percent of the total gold in the ore. The maximum gold concentration in the liquid occurred 0.5 hour after initiating simultaneous leaching and electrodeposition.

EXAMPLE 5

An 880 gram sample of Generator Hill ore was comminuted to a particle size of minus 100 mesh, and the comminuted ore was slurried with water to about 45 percent solids. Sodium carbonate and cupric chloride were added in amounts equivalent to 75 pounds per ton of ore and 50 milligrams per liter of aqueous phase, respectively. Copper in sheet form, which provided a ratio of metal surface to ore of 0.02 square foot per pound, was immersed in the slurry. A negative electric potential of −2 volts was applied on the copper and a stainless steel rod served as the anode. Sodium cyanide was added in an amount equivalent to 1 gram per liter of aqueous phase. The slurry was aerated with 200 cc/min of air for 12 hours at about 75° F. followed by phase separation and analysis. The aqueous phase of the slurry was analyzed to contain 0.5 milligram of gold per liter; the solids analysis was 0.249 ounce of gold per ton; and a 20 percent recovery was obtained. The maximum gold concentration in the liquor was 1.23 milligrams of gold per liter, which represents 14 percent of the total gold present in the ore. The maximum gold concentration in the liquor occurred 0.25 hour into the test.

EXAMPLE 6

An 880 gram sample of Generator Hill ore was tested in the same manner as in Example 1. The cathode metal used was stainless steel in sheet form, which provided a ratio of metal surface to ore of 0.02 square foot per pound. After a retention time of 16 hours, phase separation was carried out. The liquid phase was found to contain 0.02 milligram of gold per liter; the solids analysis was 0.005 ounce of gold per ton; and a 98 percent recovery of gold was obtained. The maximum gold concentration in the liquid phase was 1.6 milligrams of gold per liter, which represents 18 percent of the total gold present in the ore. The maximum gold concentration occurred 0.5 hour after initiating the simultaneous leaching and electrodeposition process.

EXAMPLE 7

An 880 gram sample of Generator Hill ore was tested under the same conditions and procedures as in Example 5, which was conducted at 75° F. The metallic cathode employed was stainless steel in sheet form which provided a ratio of metal surface to ore of 0.03 square foot per pound. After 12 hours, the phases were separated and examined for gold content. The liquor contained 0.22 milligram of gold per liter; the solid phase analysis was 0.215 ounce of gold per ton; and a 29 percent recovery of gold was obtained. The maximum gold concentration in the liquid phase was 1.5 milligrams of gold per liter, which value represents 17 percent of the total gold present in the ore. The maximum gold concentration in the liquid phase occurred 0.5 hour into the test.

EXAMPLE 8

A 500 gram sample of Generator Hill ore was tested according to the procedure of Example 2. The reducing metal employed was stainless steel in a thin sheet form, which provided a ratio of metal surface to ore of 0.19 square foot per pound. The slurry was stirred and aerated for 24 hours, followed by phase separation and analysis. No electrical potential was applied. The liquor was found to contain 0.01 milligram of gold per liter; the solids analysis was 0.210 ounce of gold per ton; and a 33 percent recovery of gold was obtained. The maximum gold concentration in the liquid phase was 0.02 milligram of gold per liter, which represents less than 1 percent of the total gold present in the ore. The maximum gold concentration in the liquid phase occurred 6 hours into the test.

EXAMPLE 9

An 880 gram sample of Generator Hill ore, which had been ground to minus 100 mesh, was slurried with water to about 45 percent solids. Sodium carbonate and cupric chloride were added in amounts equivalent to 75 pounds per ton of ore and 50 milligrams per liter of aqueous phase, respectively, and the slurry was heated to 180° F. A stainless steel coupon served as the cathode, which provided a ratio of metal surface to ore of 0.03 square foot per pound. A negative potential of −2 volts was applied to the coupon, and a stainless steel rod served as the anode. Sodium cyanide was added to the heated, stirred slurry in an amount equivalent to 0.5 gram per liter of aqueous phase. The slurry was stirred and heated for 16 hours, during which no means was provided to purposely aerate the slurry. At the end of the 16 hours, the phases were separated and analyzed. The aqueous phase was determined to contain 0.02 milligram of gold per liter, and the solids were found to contain 0.069 ounce of gold per ton. These values correspond to an overall gold recovery of 78 percent. The maximum gold concentration measured in the liquor was 0.18 milligram per liter, which occurred 4 hours into the test. The maximum measured gold concentration in the liquor corresponded to 2 percent of the total gold present in the ore sample.

What is claimed is:

1. Process for improving the recovery of a precious metal from an ore, comprising:

(a) preparing an aqueous slurry of said precious metal containing ore in ground form, said ore is a member selected from a group consisting of a carbonaceous ore and a mixture of a carbonaceous ore and an oxide ore;

(b) simultaneously leaching and electrodepositing said precious metal from said aqueous slurry of ore in ground form at a temperature between about 140° and 200° F. by:

(i) adding sufficient alkaline material to said aqueous slurry to maintain the liquid phase of said aqueous slurry at a pH between 9.5 and 12;

(ii) adding an effective amount of a precious metal-complexing agent to said aqueous slurry;

(iii) contacting said slurry for 1–48 hours with a cathode made of a metal selected from the group consisting of cadmium, iron, lead, molybdenum, tin, zinc, cobalt, nickel, silver, titanium, tungsten, vanadium, alloys of at least one of such metals and mixtures of at least one of such metals in an amount which provides a ratio of cathode metal surface to ore of 0.01 to 1.0 square foot per pound of dry ore; and (iv) applying an external negative electric potential to said cathode, whereby simultaneous leaching and electrodeposition of said precious metal occur; and (c) separating said cathode and electrodeposited precious metal from said aqueous slurry whereby at least 75 percent of the precious metal originally present in said ore is recovered, and wherein said improvement in the recovery of said precious metal is the result of the use of said temperature of between about 140° and 200° F., and wherein said improvement in the recovery of said precious metal is independent of a rate of reaction of the process and a concentration of solubilized precious metal.

2. Process as claimed in claim 1 wherein said small external negative electric potential is between −1.0 and −3.0 volts.

3. Process as claimed in claim 1 wherein said precious metal complexing agent is selected from the group consisting of sodium cyanide, potassium cyanide, sodium chloride, sodium thiosulfate and thiourea.

4. Process as claimed in claim 3 wherein said precious metal-complexing agent is sodium cyanide.

5. Process as claimed in claim 4 wherein said sodium cyanide is used in an amount equivalent to between 0.05 and 5.0 grams per liter of the aqueous phase of said slurry.

6. Process as claimed in claim 1 wherein said precious metal-complexing agent is used in the form of an aqueous solution.

7. Process as claimed in claim 1 wherein said cathode metal is copper.

8. Process as claimed in claim 1 wherein said cathode metal is iron.

9. Process as claimed in claim 1 wherein said cathode metal is stainless steel.

10. Process as claimed in claim 1 wherein said cathode metal is used in an amount which provides a ratio of cathode metal surface to ore of 0.02 to 0.80 square foot per pound of dry ore.

11. Process as claimed in claim 1 wherein said alkaline material is a hydroxide, carbonate or oxide of an alkali metal or an alkaline earth metal.

12. Process as claimed in claim 1 wherein said alkaline material is sodium carbonate.

13. Process as claimed in claim 12 wherein said sodium carbonate is used in an amount equivalent to between 10 and 100 pounds of $Na_2CO_3$ per ton of ore.

14. Process as claimed in claim 1 wherein said ore is a carbonaceous ore.

15. Process as claimed in claim 1 wherein said ore is mixture of a carbonaceous and an oxide ore.

16. Process as claimed in claim 1 wherein said aqueous solution contains between 25 and 60 percent by weight of solids.

17. Process as claimed in claim 1 wherein said aqueous solution contains between 35 and 50 percent by weight of solids.

18. Process as claimed in claim 1 wherein the ore is in a particulate form having a particle size of less than 10 mesh.

19. Process as claimed in claim 1 wherein said slurry is aerated during said simultaneous leaching and electrodeposition step.

20. Process as claimed in claim 1 wherein a copper or lead salt is added to the aqueous phase of said slurry.

21. Process as claimed in claim 1 wherein said precious metal is recovered from the electrodeposition product, containing said precious metal, resulting from said simultaneous leaching and electrodeposition step.

22. A process to extract a precious metal from carbonaceous ores, comprising:

(a) grinding said carbonaceous ores;

(b) forming an aqueous slurry of said ground, carbonaceous ore;

(c) mixing said slurry with a complexing agent and obtaining a concentration of solubilized precious metal;

(d) heating to said slurry to a temperature of between 140° and 200° F. to predispose said precious metal deposited as a solid in said ore toward release from said slurried ore and wherein said concentration of solubilized precious metal remains approximately constant;

(e) contacting said slurry with a cathode; and (f) applying a negative electrical potential to said cathode in an amount sufficient to simultaneously leach said precious metal from said slurried ore and electrodeposit said leached precious metal and wherein a completeness of extraction of said precious metal from said ore is independent of a rate of reaction of the process.

23. The process of claim 22 wherein said heat raises a temperature of said slurry to between about 140° F. and about 200° F.

24. The process of claim 22 wherein said complexing agent is a cyanide compound.

25. The process of claim 22 wherein said precious metal is a member of a group consisting of silver, gold, and a mixture of silver and gold.

26. The process of claim 22 wherein said slurry has an alkaline pH.

27. A process to extract gold from carbonaceous ore, comprising:

(a) forming a slurry of a ground gold-containing carbonaceous ore;

(b) mixing said carbonaceous ore slurry with a cyanide complexing agent and obtaining a concentration of solubilized gold;

heating said cyanide-containing slurry to a temperature between about 140° and 200° F. to achieve a reaction temperature sufficient to precondition said gold deposited as a solid metal in said ore for separation from said ore and wherein said concentration of solubilized gold remains approximately constant;

(d) contacting said slurry with a cathode; and (e) applying a negative electrical potential to said cathode in an amount sufficient to simultaneously leach said gold from said slurried ore and electrodeposit said leached gold and wherein a completeness of extraction of said gold from said ore is independent of a rate of reaction of the process.

28. The process of claim 27 wherein said heat raises said temperature of said slurry to between about 140° F. and about 200° F.

* * * * *